US009719262B2

(12) United States Patent
Halischuk

(10) Patent No.: US 9,719,262 B2
(45) Date of Patent: Aug. 1, 2017

(54) KIT OF PARTS FOR TRIMMING STEP EDGES

(71) Applicant: Cory Halischuk, Clandeboye (CA)

(72) Inventor: Cory Halischuk, Clandeboye (CA)

( * ) Notice: Subject to any disclaimer, the term of this patent is extended or adjusted under 35 U.S.C. 154(b) by 17 days.

(21) Appl. No.: 14/753,208

(22) Filed: Jun. 29, 2015

(65) Prior Publication Data

US 2016/0376793 A1 Dec. 29, 2016

(51) Int. Cl.

| | |
|---|---|
| ***E04F 11/16*** | (2006.01) |
| ***E04F 11/17*** | (2006.01) |
| ***F21V 33/00*** | (2006.01) |
| *F21S 4/20* | (2016.01) |
| *E04F 11/104* | (2006.01) |
| *F21Y 103/10* | (2016.01) |
| *F21Y 115/10* | (2016.01) |

(52) U.S. Cl.

CPC ..... *E04F 11/166* (2013.01); *E04F 11/17* (2013.01); *F21V 33/006* (2013.01); *E04F 11/175* (2013.01); *E04F 2011/1048* (2013.01); *F21S 4/20* (2016.01); *F21Y 2103/10* (2016.08); *F21Y 2115/10* (2016.08)

(58) Field of Classification Search

CPC ..... E04F 11/166; E04F 11/16; E04F 11/175; E04F 11/17; E04F 2011/1048

USPC ..... 52/179, 188

See application file for complete search history.

(56) References Cited

U.S. PATENT DOCUMENTS

| | | | | | |
|---|---|---|---|---|---|
| 4,625,266 | A * | 11/1986 | Winter | F21V 33/006 | 362/145 |
| 5,222,799 | A * | 6/1993 | Sears | F21S 8/037 | 362/146 |
| 5,806,253 | A * | 9/1998 | Nelson | E04F 11/166 | 52/179 |
| 6,115,975 | A * | 9/2000 | Abdollahi | E04F 11/16 | 52/179 |
| 6,606,827 | B1 * | 8/2003 | Hoffmann | G09F 13/22 | 362/146 |
| 8,033,063 | B2 * | 10/2011 | Won | E04F 11/02 | 52/179 |
| 2010/0071283 | A1 * | 3/2010 | Quinn | E04F 11/17 | 52/179 |
| 2011/0162302 | A1 * | 7/2011 | Barrett | E04F 11/17 | 52/179 |
| 2011/0179729 | A1 * | 7/2011 | Thompson | E04F 11/104 | 52/179 |

(Continued)

*Primary Examiner* — Phi A

(74) *Attorney, Agent, or Firm* — Adrian D. Battison; Ade & Company Inc

(57) ABSTRACT

An apparatus for trimming step edges includes an elongate member forming a nose piece for mounting at an edge of a horizontal existing surface. The member comprises a rear surface, a front face, a top surface extending therebetween, and a groove in the front face of the member. The groove has first and second side walls extending from first and second side edges at the front face and leading to a base recessed therefrom. The member is supported by screws received in the groove in a mounted position wherein the top surface of the member is spaced above the existing surface so that a thickness of a covering material, which disposed on the existing surface for covering same, is located between the top surface and the existing surface. Also, a lighting element is inserted in the groove for illuminating an area adjacent the edge of the existing surface.

17 Claims, 4 Drawing Sheets

(56) References Cited

U.S. PATENT DOCUMENTS

| | | | | |
|---|---|---|---|---|
| 2014/0049949 | A1* | 2/2014 | Spurgeon | B44C 3/10 362/145 |
| 2014/0290159 | A1* | 10/2014 | Mang, Sr. | E04F 11/163 52/188 |
| 2015/0361670 | A1* | 12/2015 | Sgambelluri | E04F 11/108 52/179 |

* cited by examiner

KIT OF PARTS FOR TRIMMING STEP EDGES

FIELD OF THE INVENTION

This invention relates to an apparatus or a kit of parts for trimming step edges for example a tread of a staircase, a step at an edge of a sunken floor, or a top edge of a short wall. In all these examples there is a tread or horizontal surface, a vertical riser meeting the horizontal surface, and a nose portion joining the vertical and horizontal surfaces.

BACKGROUND

Known constructions of staircase nose pieces may have potential shortcomings.

The applicant provides a unique solution for staircase nose pieces and more generally for apparatus for trimming step edges that improves upon existing constructions of same.

SUMMARY OF THE INVENTION

It is one object of the invention to provide an improved arrangement for trimming step edges for example a tread of a stair case, a step at an edge of a sunken floor or a top edge of a short wall.

According to one aspect of the invention there is provided an apparatus for trimming a step edge comprising:

- a vertical riser board meeting a horizontal existing surface at or adjacent an edge of the existing surface;
- a facing material covering the riser board;
- an elongate member forming a nose piece above the facing material for mounting at the edge of the existing surface, the member having:
  - a vertical rear surface along the riser board;
  - a front face defining an attractive face that is opposite the rear surface;
  - a horizontal top surface extending between the rear surface and the front face;
  - an upper edge at a junction of the top surface and the front face;
  - a lower edge at a bottom of the front face along the facing material;
  - a continuously longitudinally extending groove in the front face of the member, the groove having:
    - a base recessed from the front face;
    - a first side edge in the front face of the member at a position spaced from the upper edge of the member and a second side edge on said front face at a position spaced from the lower edge of the member;
    - a first side wall extending from the base to the first side edge and a second side wall extending from the base to the second side edge; and
- a series of screws in the groove at spaced positions along the base thereof;
- the screws fastening the member in a mounted position in which the top surface of the member is spaced above the existing surface such that a thickness of a covering material which is disposed on the existing surface for covering the existing surface is located between the top surface of the member and the existing surface.

In the embodiment as described in more detail hereinafter, the apparatus or kit of parts for trimming step edges may be suited for installation independent of an attractive covering material (e.g., cladding) for covering the existing surface.

Also, the nose piece is shaped so as to cooperate with the riser board and the facing material covering the riser board so as to provide a clean, attractive appearance. Furthermore, placement of the screws in the groove for fastening the member in its mounted position enhances the clean, attractive appearance.

Note that 'contiguous' as used herein means 'touching or connected throughout in an unbroken sequence'.

Preferably, the member further includes a rear flange portion at a top of the rear surface that protrudes beyond the rear surface at a position spaced above the existing surface and an upper surface of the rear flange portion defines a continuation of the top surface. It is preferred that the riser board extends above the existing surface such that the rear flange portion of the member is disposed over a top of the riser board. In a preferred arrangement, the rear flange portion resides on the top of the riser board. Preferably, the riser board has an outer face which is covered by the facing material and an opposing inner face, and a free end of the rear flange portion and the inner face of the riser board are substantially flush in a vertical plane.

Preferably, the member further comprises a cutaway portion at a bottom of the rear surface that has an inner end surface which is recessed from the rear surface towards but spaced from the front face so as to form a lip at the bottom of the front face such that the facing material is received in the cutaway portion and the lip overlaps an outer face of the facing material. It will be appreciated that 'cutaway' as used in this specification refers to a shape of the member and does not necessarily refer to a part of the member which has formed by cutting away part of the member.

Preferably, the front face is inclined in a vertical direction from the lower edge to an intermediary location between the lower and upper edges such that the intermediary location on the front face is forwardly proud of the lower edge.

In other words, it is preferred that the front face comprises a lower face portion which is inclined in the vertical direction between the lower edge and an intermediary location between the lower and upper edges such that the intermediary location is forward of the lower edge and an upper face portion which extends from the intermediary location towards the upper edge. Preferably, the groove is located in the lower face portion so as to face downwardly.

Preferably, the screws are recessed in the groove from the front face of the member. Preferably, the apparatus includes a plastic strip inserted into the groove along a length of the board that covers the screws therein. Preferably, the plastic strip comprises a cap portion outside the groove and an insert portion extending into the groove. The cap portion has first and second side edges and an outer surface therebetween. The first side edge of the cap portion is located at a position spaced from the first side edge of the groove toward but spaced from the upper edge. Similarly, the second side edge of the cap portion is located at a position spaced from the second side edge of the groove toward but spaced from the lower edge. As such, preferably the cap portion covers the groove and the outer surface of the cap portion is contiguous with the front face. In one instance, the apparatus includes a lighting element arranged for generating light that is disposed in the groove so as to be located therein between the base of the groove and the plastic strip which is translucent for permitting passage of the light generated by the lighting element therethrough. In other embodiments, the plastic strip may also be transparent.

In one instance, the apparatus includes a lighting element arranged for generating light that is inserted in the groove for illuminating an area adjacent the edge of the existing surface. In this instance, the apparatus includes the lighting element without necessarily having the translucent or transparent plastic strip.

According to another aspect of the invention there is provided an apparatus for trimming a step edge for example a tread of a staircase, a step at an edge of a sunken floor or a top edge of a short wall, comprising:

- an elongate member forming a nose piece for mounting adjacent a horizontal existing surface at an edge of the existing surface, the member having:
- an elongate member forming a nose piece for mounting adjacent a horizontal existing surface at an edge of the existing surface, the member having:
  - a vertical rear surface;
  - a front face defining an attractive face that is opposite the rear surface;
  - a horizontal top surface extending between the rear surface and the front face;
  - an upper edge at a junction of the top surface and the front face;
  - a lower edge at a bottom of the front face;
  - a continuously longitudinally extending groove in the front face of the member, the groove having:
    - a base recessed from the front face;
    - a first side edge in the front face of the member at a position spaced from the upper edge of the member and a second side edge on said front face at a position spaced from the lower edge of the member;
    - a first side wall extending from the base to the first side edge and a second side wall extending from the base to the second side edge; and
- a series of screws in the groove at spaced positions along the base thereof;
- a lighting element arranged for generating light that is inserted in the groove for illuminating an area adjacent the edge of the existing surface.

The embodiment as described in more detail hereinafter provides a nose piece which has a clean, attractive appearance and augments safety of ascending or descending one or more steps in dimly lit environments.

Preferably, the screws are recessed from the front face. In one instance, the lighting element comprises a strip of light emitting diodes (LEDs) extending longitudinally along a majority of the length of the groove such that the screws in the groove are covered by the strip of LEDs.

When the screws are recessed from the front face, in one instance the apparatus includes a translucent plastic strip inserted into the groove along a length of the board that covers the screws and lighting element therein while permitting passage of light generated by the lighting element therethrough. In other embodiments, the plastic strip may also be transparent. When the apparatus includes the translucent plastic strip and the lighting element comprises the strip of LEDs, the strip of LEDs is located in the groove between the screws and the plastic strip.

Preferably, the front face is inclined from the lower edge to an intermediary location between the lower and upper edges such that the intermediary location is transversely outwardly proud of the lower edge thereby forming an inclined lower face portion and an upper face portion which extends from the intermediary location to the upper edge, and the groove is located in the lower face portion such that the lighting element is oriented downwardly for illuminating the area that is below the existing surface. When the front face is inclined such that the intermediary location on the front face is proud of the lower edge, in one instance the base of the groove is parallel to the front face at the lower face portion.

All or any of the above features may be combined.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
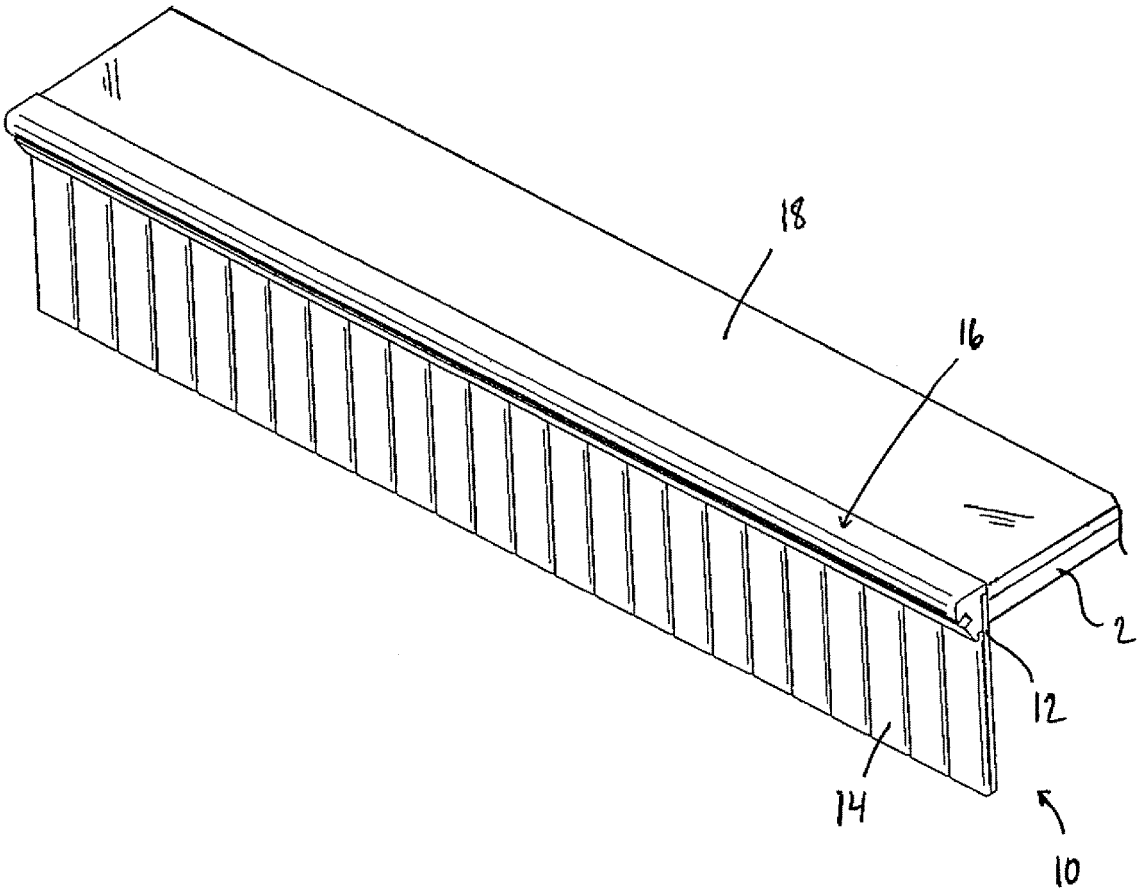
FIG. 1 is a perspective view of an apparatus for trimming step edges according to the present invention omitting a lighting element and plastic strip for clarity of illustrating relative positions of each piece of the apparatus relative to a horizontal existing surface and an attractive cladding thereon.
Figure 2:
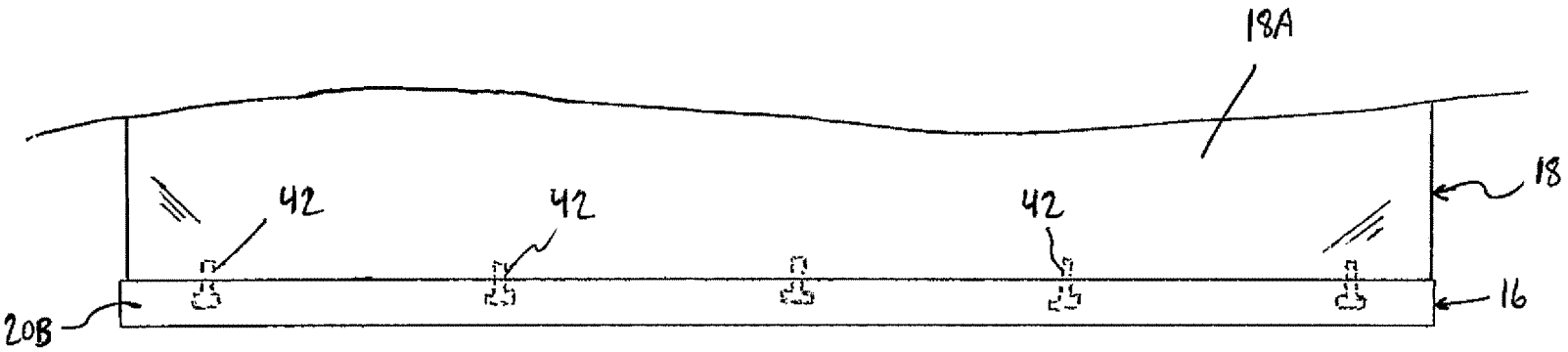
FIG. 2 is a top plan view of the apparatus of FIG. 1 schematically showing screws fastening the nose piece to a tread defining the existing surface.
Figure 3:
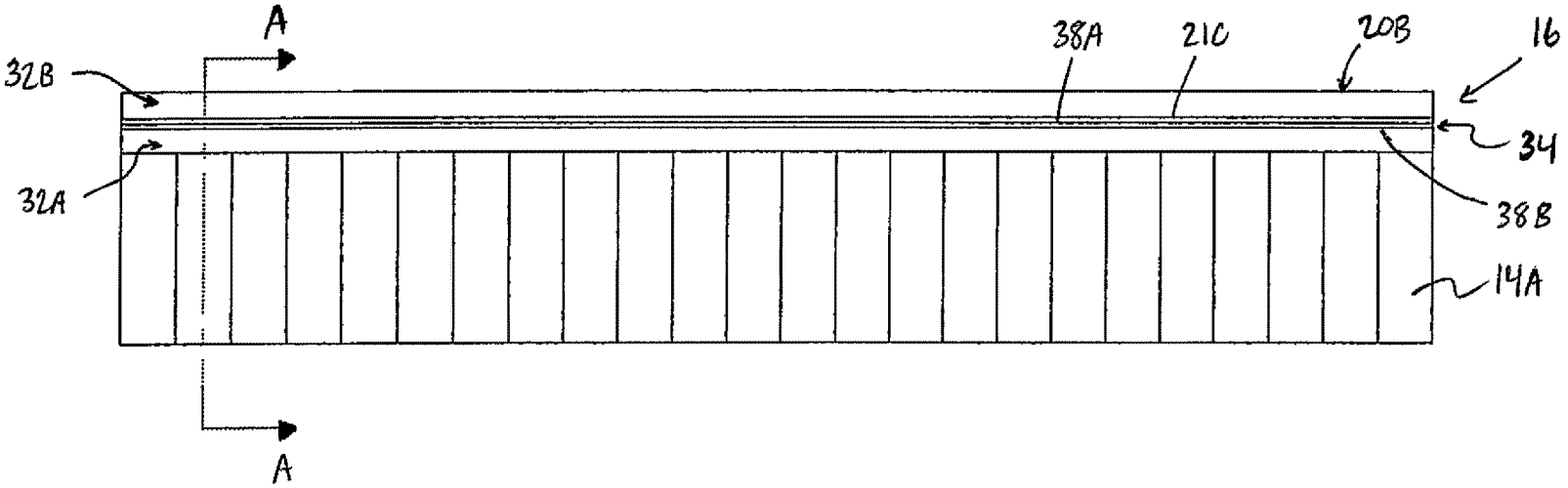
FIG. 3 is an elevation view of the apparatus of FIG. 1 omitting the lighting element and plastic strip that are inserted into the groove.
Figure 4:
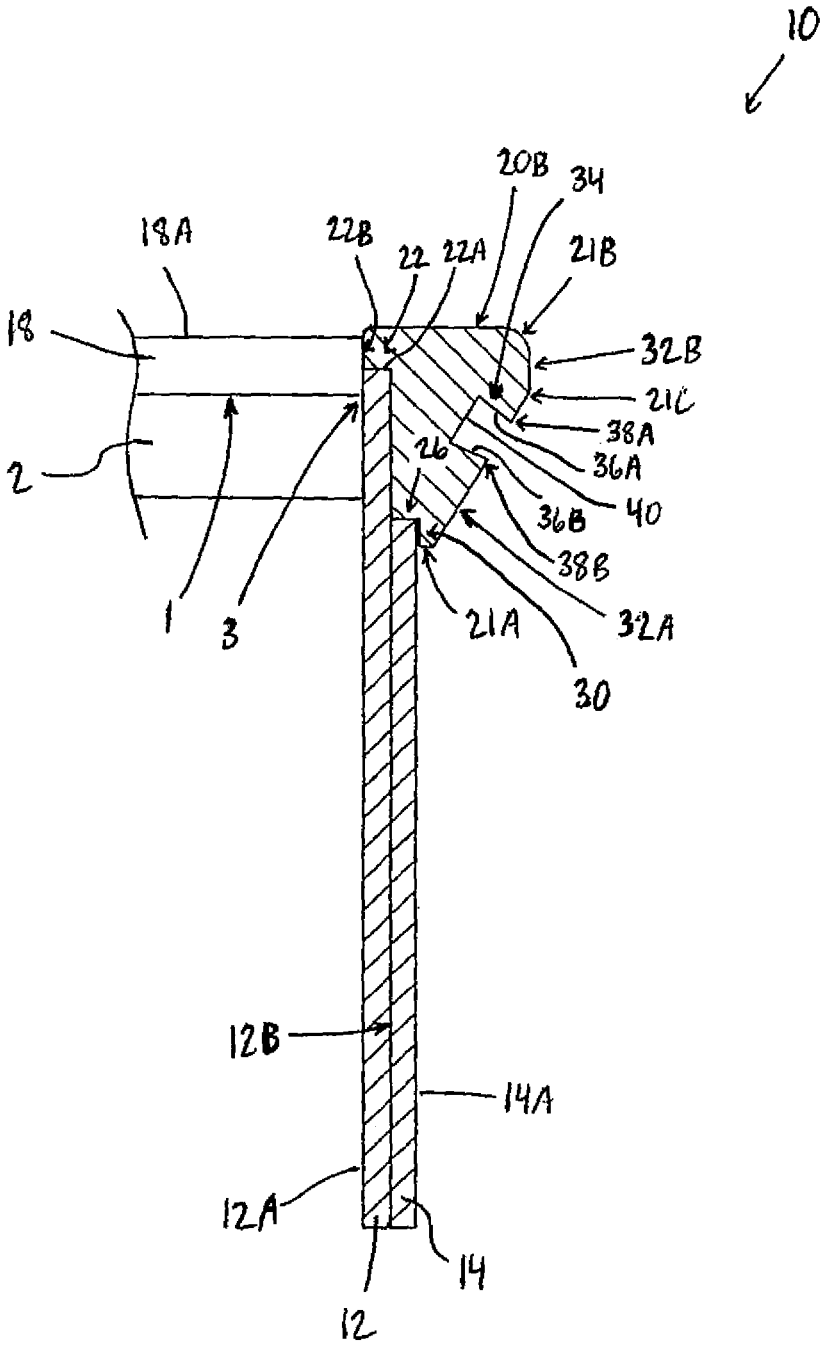
FIG. 4 is a cross-sectional view along line A-A in FIG. 3 omitting the lighting element and plastic strip that are inserted into the groove.

Referring to the accompanying figures there is illustrated an apparatus for trimming a step edge that is generally indicated by reference numeral 10. The step edge for which the apparatus 10 may be suited includes that of a tread of a staircase, a step at an edge of a sunken floor, or a top edge of a short wall. In the illustrated embodiment, a horizontal existing surface 1 is defined by an upper surface 1 of the tread 2 of the staircase.

As such, the apparatus 10 comprises a riser board 12 oriented vertically so as to meet the tread at a free tread edge 3 thereof. The free tread edge lies along a longitudinal reference axis which is used herein. In the illustrated embodiment, the riser board 12 is positioned and sized so as to extend above the upper surface 1 of the tread such that the riser board is in front of the tread and an inner surface 12A of the riser board is adjoining the upper surface 1 of the tread along the free tread edge 3. In alternative embodiments, the riser board may be positioned such that the inner surface is butting against the tread 2 and the riser board is sized such that a top of the riser board is below the upper surface 1 of the tread. In further alternative embodiments, the riser board may be positioned and sized such that an outer surface 12B is flush with the free tread edge 3 in a vertical plane which may be defined by the riser board (and more particularly, the vertical plane is defined by the outer surface 12B). For example, the riser board may be made of plywood.

Additionally, the apparatus 10 comprises a facing material 14 for covering the outer surface 12B of the riser board. More specifically, the facing material 14 covers a lower surface portion of the outer surface 12B of the riser board as will become apparent later. The facing material provides an attractive and finished appearance to a riser of the step. For example, the facing material may comprise a wood veneer or a marble slab.

The apparatus 10 further includes a longitudinally elongate member 16 which forms a nose piece. As such, the member is referred to as the nose piece hereinafter. The nose piece 16 joins a vertical attractive surface defined by an outer surface 14A of the facing material 14 and a horizontal attractive surface defined by an upper surface 18A of a covering material 18 disposed on the existing surface 1 for covering same. For example, the covering material may comprise interlocking hardwood or laminate flooring pieces, a wooden slab, a marble slab, or a granite slab. The covering material 18 is not necessarily included as part of the apparatus 10 and may be sold separately therefrom.

The nose piece 16 has a rear surface 20A, a top surface 20B, and a front face 20C which defines an attractive face of the nose piece. The front face 20C has a lower edge 21A at a bottom of the front face and an upper edge 21B at a junction of the top surface 20B and the front face 20C. The upper edge 21B is rounded such that the junction of the top surface and front face is smooth.

The nose piece comprises a rear flange portion 22 at a top of the rear surface 20A so as to be opposite the upper edge 21B at the junction of the top surface 20B and the front face 20C. The rear flange portion 22 extends transversely of the rear surface 20A so as to protrude therefrom. The rear flange portion has a lower stepped surface 22A which is oriented perpendicularly to the rear surface 20B so as to form an upper shoulder 24 where the lower stepped surface and the rear surface converge. The rear flange portion also has a rear end surface 22B at a free end of the rear flange portion that is spaced transversely of the rear surface 20A and is in parallel relation to the rear surface. Note that the top surface spans from a front of the nose piece at the upper edge 21B to a rearmost end of the nose piece at the rear end surface 22B of the rear flange portion. As such, an upper surface portion of the rear flange portion 22 defines part of the top surface 20B.

Further to the rear flange portion, the nose piece comprises a cutaway portion 26 at a bottom of the rear surface 20A so as to be adjacent the lower edge 21A of the front face. The cutaway portion comprises an inner end surface 26A recessed transversely from the rear surface 20A toward but spaced from the front face 20C. The inner end surface 26A is parallel to the rear surface 20A. An upper stepped surface 26B of the cutaway portion 26 is oriented perpendicularly to both the rear surface 20A and the inner end surface 26A. A lower shoulder 28 is formed where the upper stepped surface 26B and inner end surface 26A converge.

The inner end surface 26A and a longitudinal bottom portion of the front face 20C form a lip 30 along the bottom of the nose piece.

Further to the lip, the front face 20C is inclined in a transverse direction from the lower edge 21A to the upper edge 21B. That is, the front face 20C is inclined from the lower edge 21A to an intermediary location 21C on the front face that is spaced from the upper edge 21B thereby forming an inclined lower face portion 32A between the lower edge and the intermediary location and an upper face portion 32B extending from the intermediary location 21C to the upper edge 21B. The intermediary location 21C is spaced further from the rear surface 20A than the lower edge 21B so as to be located transversely proud of the lower edge. The upper face portion 32B is parallel to the rear surface 20A.

The nose piece 16 also includes a continuously longitudinally extending groove 34 in the front face 20C of the nose piece. In the illustrated embodiment, the groove 34 is disposed in the lower face portion 32A of the front face. The groove comprises reverse tapered first and second side walls 36A, 36B leading from first and second side edges 38A, 38B respectively on the front face 20C to a base 40 recessed from the front face. As such, the spacing between the first and second side walls 36A, 36B of the groove increases towards the base 40. Furthermore, the first side edge 38A is located at a position spaced from the upper edge 21B and the intermediary location 21C so as to be between the intermediary location and the lower edge 21A, and the second side edge 38B is located at a position spaced from the lower edge 21A so as to be closer to the lower edge than the first side edge 38A is thereto. Moreover, the base 40 is oriented parallel to the front face 20C at the lower face portion 32A in the illustrated embodiment.

Turning now to a collective arrangement of the apparatus 10, the riser board 12 is installed vertically upright at the free edge 3. Typically, the facing material 14 is fastened to the riser board, which may be effected by an adhesive such as glue. The nose piece 16 is positioned against the riser board 12 above the facing material 14, with the rear flange portion 22 residing on the top of the riser board 12 so as to be thereover. Thus, the lower stepped surface 22A of the rear flange portion overlaps the top of the riser board in butting engagement therewith. As such, the rear surface 20A of the member is oriented vertically and is in butting engagement with the outer surface 12B of the riser board. Furthermore, the facing material 14 is received in the cutaway portion 26 such that the upper stepped surface 26B of the cutaway portion is in butting engagement with a top of the facing material 14 and the lip 30 overlaps an outer face 14A of the facing material. The lip 30 may be suited for retaining the facing material 14 in its position covering the riser board 12.

A series of screws 42 are received in the groove 34 at spaced positions along the base 40 of the groove for mounting the member 16. The screws are recessed in the groove from the front face 200. In the arrangement shown, the screws pass through the rear surface 20A of the member 16, through the riser board 12 and into the tread. In this manner, the screws 42 support the nose piece 16 in its mounted position as better shown in FIGS. 1 and 5.

In the mounted position, the rear surface 20A is fastened to the riser board 12. The screws of the illustrated arrangement also fasten the riser board 12 to the tread 2. Furthermore, the rear end surface 22B of the rear flange portion is flush with the inner surface 12A of the riser board in a vertical plane defined by the inner surface 12A of the riser board in the illustrated embodiment. Additionally, the top surface 20B is oriented horizontally and presented at a position spaced above the upper surface 1 of the tread 2 so that the covering material 18 may be disposed on the upper surface 1 of the tread 2 in a height between the top surface 20B and the upper surface 1 of the tread. The covering material along its thickness fits within the height between the top surface 20B of the nose piece and the upper surface of the tread. In other words, a thickness of the covering material, as measured between the upper surface 18A of the covering material and an opposing lower surface thereof which is in contact with the upper surface 1 of the tread 2, is located between the top surface 20B of the member and the existing surface when the covering material 18 is disposed on the tread 2. As such, the upper surface 18A of the covering material is located (at an elevation) between the top surface 20B of the nose piece and the upper surface 1 of the tread 2. Thus, the top surface 20B of the nose piece and the upper surface 18A of the covering material are contiguous. A flat end 44 of the covering material 18 abuts the rear end surface 22A of the rear flange portion. The flat end 44 of the covering material also abuts the inner surface 12A of the riser board in the illustrated embodiment. Adhesive may be added between the lower surface of the covering material 18 and the upper surface 1 of the tread suited for fastening of the covering material thereto; however, it will be appreciated that adhesive between these two surfaces is not required. As such, the mounted position of the nose piece 16 may be suited for retaining the covering material 18 in its installed position on the upper surface 1 of the tread. The screws 42 and shaping of a rear of the nose piece 16 including the rear flange portion 22, rear surface 20A, and lip 30 cooperatively with the riser board 12 and facing material 14 may be suited for supporting the nose piece 16 in its mounted position as clearly shown in FIG. 5. Furthermore, the illustrated arrangement provides an apparatus for trimming step edges in which the covering material may be installed on the existing surface 1 (i.e., the upper surface of the tread of the illustrated embodiment) independent of the nose piece 16, riser board 12, and facing material 14. It will be appreciated that the covering material 18 and nose piece 16 do not necessarily have to be shaped (as, for example, with a cooperating ridge and channel on each respective component) to cooperate together for fastening the covering material and nose piece; however, in other embodiments, the nose piece 16 and covering material 18 may comprise such cooperating elements such as a ridge on one of the nose piece and covering material and a channel in another one of the nose piece and covering material for cooperatively fastening together.

Figure 5:
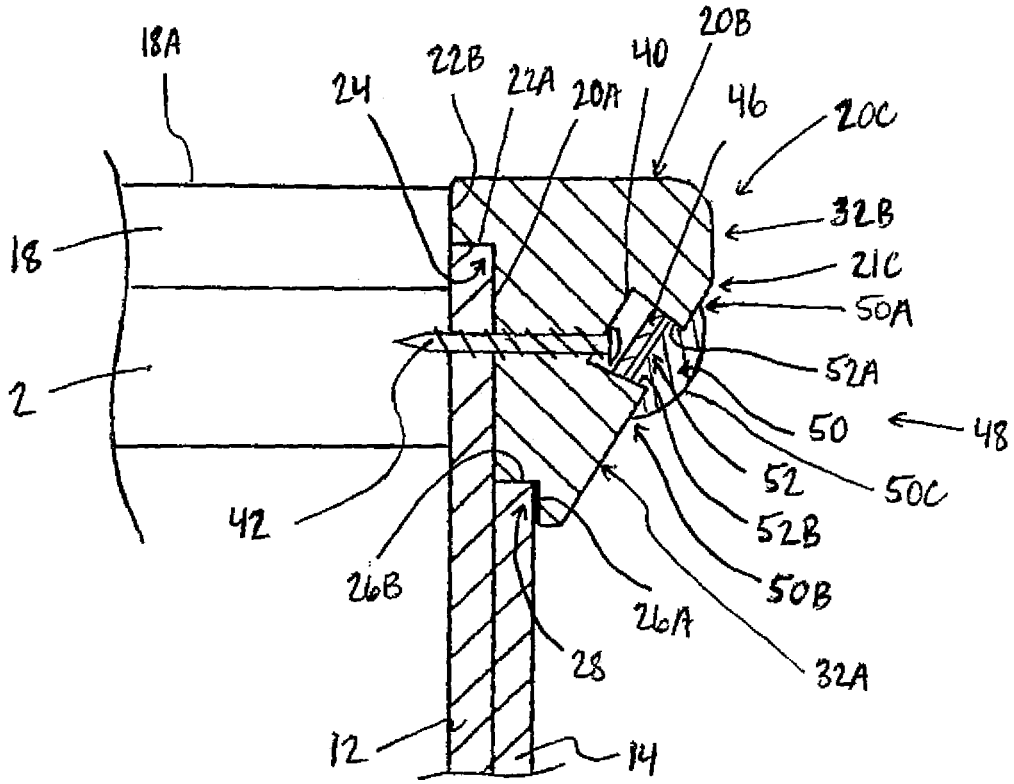
FIG. 5 is an enlarged cross-sectional view along line A-A in FIG. 3 emphasizing an interface between components at a top of the apparatus and schematically illustrating the lighting element and plastic strip.

Further to the screws, a lighting element 46 shown schematically in FIG. 5 is inserted in the groove 34. The lighting element 46 is arranged for generating light so as to be suited for illuminating an area adjacent the free tread edge 3. Since the groove 34 is disposed in the lower face portion 32A, the illuminated area lies below the upper surface 1 of the tread 2. In the illustrated embodiment, the lighting element comprises a strip of LEDs (in other words, a LED strip). The LED strip 46 extends longitudinally along the length of the groove so as to cover the screws 42 therein. Furthermore, the LED strip is connected to its power source (not illustrated). Such LED strips are known in the art and thus not described in detail herein.

A translucent plastic strip 48 is inserted into the groove 34 along the length of the nose piece 16. As such, the lighting element 46 is sandwiched generally between the base 40 of the groove and the plastic strip 48. In other words, the lighting element is disposed in between or intermediate the base of the groove and the plastic strip. Depending on an extent to which the screws 42 protrude from the base 40, the lighting element 46 may be sandwiched between the screws 42 and the plastic strip 48. In the illustrated embodiment, the plastic strip covers the groove 34 and the screws 42 and lighting element 46 therein; however, the plastic strip is translucent as mentioned before so as to be arranged to permit passage of the light generated by the lighting element 46 through the plastic strip for illuminating the area adjacent the tread.

The plastic strip 48 has a cap portion 50 outside the groove 34 and an insert portion 52 extending into the groove. Respective side edges of the insert portion cooperate with the first and second side walls 36A and 36B of the groove 34 to restrain the insert portion against movement out of the groove. The cap portion 50 has first and second side edges 50A, 50B and an outer surface 50C therebetween. In the illustrated embodiment, the first side edge 50A of the cap portion is located on the front face 20C of the nose piece at a position spaced from the first side edge 38A of the groove toward but spaced from the intermediary location 21C on the front face. The second side edge 50B of the cap portion is located on the front face 20C of the board at a position spaced from the second side edge 38B of the groove toward but spaced from the lower edge 21B. Thus, the plastic strip 48 covers the groove 34 and the outer surface 50C of the cap portion is contiguous with the front face 20C. Moreover, the outer surface 50C of the cap portion is domed in transverse cross-section so as to extend transversely proud of the front face 20C. The domed outer surface 50C of the cap portion tapers to a sharp edge at the front face 20C. In other embodiments, the insert portion 52 of the plastic strip may comprise arrow shaped fins engaging side walls of the groove 34.

Note that in other embodiments the rear surface may be fastened against the tread 2 so that the member is carried by the screws at the tread.

Also, in alternative embodiments, the upper surface 18A of the covering material may be coplanar with the top surface 20B of the nose piece so as to lie in a common horizontal plane.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. Apparatus for trimming a step edge for example a tread of a staircase, a step at an edge of a sunken floor, or a top edge of a short wall, comprising:

a vertical riser board meeting a horizontal existing surface at or adjacent an edge of the existing surface;

a facing material covering the riser board;

an elongate member forming a nose piece above the facing material for mounting at the edge of the existing surface, the member having:

a vertical rear surface along the riser board;

a front face defining an attractive face that is opposite the rear surface;

a horizontal top surface extending between the rear surface and the front face;

an upper edge at a junction of the top surface and the front face;

a lower edge at a bottom of the front face along the facing material;

a continuously longitudinally extending groove in the front face of the member, the groove having:

a base recessed from the front face;

a first side edge in the front face of the member at a position spaced from the upper edge of the member and a second side edge on said front face at a spaced position from the upper edge of the member but farther therefrom than the first side edge;

a first side wall extending from the base to the first side edge and a second side wall extending from the base to the second side edge; and a series of screws in the groove at spaced positions along the base thereof;

the screws fastening the member in a mounted position in which the top surface of the member is spaced above the existing surface such that a thickness of a covering material which is disposed on the existing surface for covering the existing surface is located between the top surface of the member and the existing surface.

2. The apparatus according to claim 1 wherein the member further includes a rear flange portion at a top of the rear surface that protrudes beyond the rear surface at a position spaced above the existing surface and an upper surface of the rear flange portion defines a continuation of the top surface.

3. The apparatus according to claim 2 wherein the riser board extends above the existing surface such that the rear flange portion of the member is disposed over a top of the riser board.

4. The apparatus according to claim 3 wherein the riser board has an outer face which is covered by the facing material and an opposing inner face, and a free end of the rear flange portion and the inner face of the riser board are substantially flush in a vertical plane.

5. The apparatus according to claim 1 wherein the member further comprises a cutaway portion at a bottom of the rear surface that has an inner end surface which is recessed from the rear surface towards but spaced from the front face so as to form a lip at the bottom of the front face such that the facing material is received in the cutaway portion and the lip overlaps an outer face of the facing material.

6. The apparatus according to claim 1 wherein the front face is inclined in a vertical direction from the lower edge to an intermediary location between the lower and upper edges such that the intermediary location on the front face is forwardly proud of the lower edge.

7. The apparatus according to claim 1 wherein the front face comprises a lower face portion inclined in a vertical direction between the lower edge and an intermediary location which is between the lower and upper edges such that the intermediary location is forward of the lower edge and an upper face portion extending from the intermediary location towards the upper edge, and the groove is located in the lower face portion so as to face downwardly.

8. The apparatus according to claim 1 wherein the screws are recessed in the groove from the front face of the member and the apparatus further comprises a plastic strip inserted into the groove along a length of the board that covers the screws therein.

9. The apparatus according to claim 8 wherein:

the plastic strip comprises a cap portion outside the groove and an insert portion extending into the groove;

the cap portion having first and second side edges and an outer surface therebetween;

the first side edge of the cap portion being located at a position spaced from the first side edge of the groove towards but spaced from the upper edge and the second side edge of the cap portion being located at a position spaced from the second side edge of the groove towards but spaced from the lower edge such that the cap portion covers the groove and the outer surface of the cap portion is contiguous with the front face.

10. The apparatus according to claim 8 further comprising a lighting element arranged for generating light that is disposed in the groove so as to be located therein between the base of the groove and the plastic strip which is translucent for permitting passage of the light generated by the lighting element therethrough.

11. The apparatus according to claim 1 further comprising a lighting element arranged for generating light that is inserted in the groove for illuminating an area adjacent the edge of the existing surface.

12. Apparatus for trimming a step edge for example a tread of a staircase, a step at an edge of a sunken floor, or a top edge of a short wall, in combination with said step edge defined at a free end of a horizontal existing surface, comprising:

an elongate member forming a nose piece mounted adjacent the horizontal existing surface at the step edge such that the member is arranged at a height of the horizontal existing surface, the member having:

a vertical rear surface located proximally to the step edge;

a front face defining an attractive face that is opposite the rear surface so as to be remote to the step edge;

a horizontal top surface extending between the rear surface and the front face located at a height no lower than that of the horizontal existing surface;

an upper edge at a junction of the top surface and the front face;

a lower edge at a bottom of the front face;

a continuously longitudinally extending groove in the front face of the member, the groove having:

a base recessed from the front face;

a first side edge in the front face of the member at a position spaced from the upper edge of the member and a second side edge on said front face at a spaced position from the upper edge of the member but farther therefrom than the first side edge;

a first side wall extending from the base to the first side edge and a second side wall extending from the base to the second side edge; and a series of screws in the groove at spaced positions along the base thereof;

a lighting element arranged for generating light that is inserted in the groove for illuminating an area adjacent the step edge.

13. The apparatus according to claim 12 wherein the screws are recessed from the front face of the member and the lighting element comprises a strip of light emitting diodes (LEDs) extending longitudinally along a majority of the length of the groove such that the screws in the groove are covered by the strip of LEDs.

14. The apparatus according to claim 12 wherein the screws are recessed from the front face of the member and the apparatus further comprises a translucent plastic strip inserted into the groove along a length of the board that covers the screws and lighting element therein while permitting passage of light generated by the lighting element therethrough.

15. The apparatus according to claim 14 wherein the lighting element comprises a strip of light emitting diodes (LEDs) extending longitudinally along a majority of the length of the groove so as to be located in the groove between the screws and the plastic strip.

16. The apparatus according to claim 12 wherein the front face is inclined from the lower edge to an intermediary location between the lower and upper edges such that the intermediary location is transversely proud of the lower edge thereby forming an inclined lower face portion and an upper face portion which extends from the intermediary location to the upper edge, and the groove is located in the lower face portion such that the lighting element is oriented downwardly for illuminating the area that is below the existing surface.

17. The apparatus according to claim 16 wherein the base of the groove is parallel to the front face at the lower face portion.

* * * * *